US006131195A

United States Patent [19]

Foreman

[11] Patent Number: 6,131,195

[45] Date of Patent: Oct. 17, 2000

[54] CUSTOM-FITTED BATTER'S LOWER LEG PROTECTOR

[75] Inventor: Louis J. Foreman, Huntersville, N.C.

[73] Assignee: Parker Athletic Products, LLC, Charlotte, N.C.

[21] Appl. No.: 09/364,212

[22] Filed: Jul. 29, 1999

[51] Int. Cl.[7] ..... A61F 5/00

[52] U.S. Cl. ..... 2/22; 2/455; 128/882; 602/6; 602/8

[58] Field of Search ..... 2/22, 16, 455, 2/267, 24; 128/878, 881, 882, 846; 602/5, 6, 7, 8, 41, 60, 65

[56] References Cited

U.S. PATENT DOCUMENTS

| | | | |
|---|---|---|---|
| 223,049 | 12/1879 | Koehler | 602/5 |
| 2,940,884 | 6/1960 | White . | |
| 3,557,156 | 1/1971 | Enneper et al. . | |
| 3,900,024 | 8/1975 | Lauber et al. . | |
| 3,923,049 | 12/1975 | Lauber et al. . | |
| 4,235,228 | 11/1980 | Gaylord, Jr. et al. . | |
| 4,279,344 | 7/1981 | Holloway, Jr. . | |
| 4,411,262 | 10/1983 | von Bonin et al. . | |
| 4,427,002 | 1/1984 | Baron et al. . | |
| 4,433,680 | 2/1984 | Yoon . | |
| 4,442,833 | 4/1984 | Dahlen et al. . | |
| 4,502,479 | 3/1985 | Garwood et al. . | |
| 4,570,622 | 2/1986 | von Bonin et al. . | |
| 4,572,171 | 2/1986 | Wegner et al. . | |
| 4,676,861 | 6/1987 | Bishop . | |
| 4,770,299 | 9/1988 | Parker . | |
| 4,869,046 | 9/1989 | Parker . | |
| 5,003,970 | 4/1991 | Parker et al. . | |
| 5,456,658 | 10/1995 | Duback et al. | 602/8 |
| 5,480,376 | 1/1996 | Duback et al. | 602/8 |
| 5,544,663 | 8/1996 | Duback . | |
| 5,637,077 | 6/1997 | Parker | 602/8 |
| 5,665,056 | 9/1997 | Nakasugi et al. | 602/8 |
| 5,732,713 | 3/1998 | Duback et al. | 128/846 |
| 5,742,938 | 4/1998 | Winningham et al. | 2/22 |
| 5,755,678 | 5/1998 | Parker et al. | 602/6 |
| 5,898,939 | 5/1999 | Schramm | 2/22 |
| 5,957,871 | 9/1999 | Darcey | 602/12 |
| 5,980,474 | 11/1999 | Darcey | 602/5 |
| 6,022,331 | 2/2000 | Darcey | 602/12 |

FOREIGN PATENT DOCUMENTS

| | | |
|---|---|---|
| 630022 | 10/1961 | Canada . |
| 2 200 286 | 9/1988 | United Kingdom . |

OTHER PUBLICATIONS

C–Splint Immobilizer (1982); Cutter Laboratories, Inc.

Scotchcast 2 Splinting System (Undated) (Orthopedic Products Division, Minnesota Mining & Manufacturing Company).

*Primary Examiner*—John J. Calvert
*Assistant Examiner*—Tejash Patel
*Attorney, Agent, or Firm*—Adams, Schwartz & Evans, P.A.

[57] ABSTRACT

A batter's lower leg protector product, including a lower leg protector for being custom-formed to the shape of a batter's lower leg while flexible and upon hardening providing a rigid, supporting custom fit. The lower leg protector product includes an outer container formed of moisture-impervious material. A flexible lower leg protector is positioned in the container in substantially moisture-free conditions and sealed therein against entry of moisture until use. The lower leg protector includes a substrate and a reactive system impregnated into or coated onto the substrate, the system remaining stable when maintained in substantially moisture-free conditions and hardening upon exposure to moisture to form a rigid, self supporting structure. A flexible protective pad is positioned on one side of the substrate to provide cushioning between the substrate and the batter when the lower leg protector is being worn. An outer cover covers the substrate on the side opposite the protective pad. The substrate, protective pad and outer cover are connected together into a unitary structure for being molded while flexible to the lower leg and ankle of the batter. Complementary fasteners are attached to opposing side edges of the lower leg protector for retaining the lower leg protector in place on the batter's leg while being worn. A foot protector having an construction optionally provides protection to the top of the foot.

10 Claims, 10 Drawing Sheets

CUSTOM-FITTED BATTER'S LOWER LEG PROTECTOR

TECHNICAL FIELD AND BACKGROUND OF THE INVENTION

This invention relates to a custom-fitted batter's lower leg protector, and is specifically intended to protect a baseball or softball batter's leg, including the ankle bones, against being directly struck by a pitched or foul-tipped ball. This type of impact has a high probability of causing severe bruising, broken or chipped bones of the lower leg, ankle or foot. A variation of the invention therefore includes a detachable foot protector which is hinged to the bottom of the lower leg protector.

The lower leg protector according to the invention takes advantage of polymer chemistry to permit quick and easy molding of the protector to the ankle. Shock attenuation is increased since the custom fit spreads contact between the protector and the lower leg over a wider surface area. Similarly, the close, custom fit achieved when the protector is properly applied to the lower leg is in distinct contrast to so-called "one size fits all" protectors now commonly used by baseball and softball players and umpires.

The protector is particularly useful with young players, whose relatively low skill level makes wild pitches more frequent and more difficult to avoid.

Prior art leg protectors include numerous types of devices which typically include a soft component to place near the skin and a hard, shell-like preformed outer cover having a shape approximating the shape of the lower leg. The soft component, for example, fiber padding or foam, is intended not only to provide a cushion, but also to accommodate itself to the varying configurations of differing sized and shaped body lower legs. For this reason, the cushioned part is substantially greater in thickness than required merely to provide the required amount of shock attenuation and protection from the rigid substrate.

Other prior art batter's leg protectors include products which are constructed of thermosetting materials which are heated and then formed to the lower leg while heated. These products require a source of heat, and are susceptible to either over-or-underheating. In addition, body heat itself can soften or increase the flexibility of the protector, thereby decreasing the effectiveness of the protection offered by the protector.

The present invention permits quick and easy application of a protector to the lower leg in such a way as to achieve a true custom fit. The moisture curable resin system used results in a very rigid protector which holds the shape of the leg to which it was molded permanently and to a very high degree. No heat is required, and a source of water is the only additional material necessary to achieve a cure. Atmospheric moisture alone will cure the protector into its hardened position in a relatively short period of time, but in practice the resin in or on the protector will typically be activated by dipping in water and then removing the excess by rolling the protector in a towel immediately before application. This can be easily done by an equipment manager or trainer as an integral part of properly equipping a player. The custom-molded protector becomes part of the equipment, together with gloves and batting hats which protect the batter against injury.

SUMMARY OF THE INVENTION

Therefore, it is an object of the invention to provide a custom-moldable batter's lower leg protector.

It is another object of the invention to provide a protector which can be molded to the lower leg of a batter for protecting the batter's lower leg while permitting inversion, eversion, dorsiflexion and planoflexion necessary during batting and running the bases.

It is another object of the invention to provide a lower leg protector which can be custom-fitted to a particular player.

It is another object of the invention to provide a lower leg protector which protects the medial and lateral ankle bones.

It is another object of the invention to provide a lower leg protector which hardens in the presence of moisture to form a very rigid but very lightweight protector.

It is another object of the invention to provide a lower leg protector in combination with a removable foot protector for protecting the top of the foot against pitched and foul-tipped baseballs and softballs.

It is another object of the invention to provide a lower leg protector in combination with a foot protector which is releasably and adjustably hinged to the leg protector.

These and other objects of the present invention are achieved in the preferred embodiments disclosed below by providing a batter's lower leg protector product, including a lower leg protector for being custom-formed to the shape of a batter's lower leg while flexible and upon hardening providing a rigid, supporting custom fit. The lower leg protector product comprises an outer container formed of moisture-impervious material. A flexible lower leg protector is positioned in the container in substantially moisture-free conditions and sealed therein against entry of moisture until use. The lower leg protector is shaped to provide, when in place on a batter's leg, protection to the front, lateral and medial aspects of the leg above the ankle and to the lateral and medial ankle bones. The lower leg protector comprises a substrate and a reactive system impregnated into or coated onto the substrate, the system remaining stable when maintained in substantially moisture-free conditions and hardening upon exposure to moisture to form a rigid, self supporting structure. A flexible protective pad is positioned on one side of the substrate to provide cushioning between the substrate and the batter when the lower leg protector is being worn. An outer cover covers the substrate on the side opposite the protective pad. The substrate, protective pad and outer cover are connected together into a unitary structure for being molded while flexible to the lower leg and ankle of the batter. Complementary fasteners are attached to opposing side edges of the lower leg protector for retaining the lower leg protector in place on the batter's leg while being worn.

Preferably, the complementary fasteners comprise patches of hook-and-loop material.

According to one preferred embodiment of the invention, the container is fabricated of an aluminum foil laminate having an outer tear resistant layer, a central aluminum foil layer and an inner heat sealable plastic layer.

According to another preferred embodiment of the invention, the substrate comprises a plurality of knitted or woven fabric layers and the protective pad comprises a foam material.

According to another preferred embodiment of the invention, the foam material is chosen from the group consisting of open or closed cell EVA or polyurethane.

According to yet another preferred embodiment of the invention, the elongate outer cover is formed of a synthetic, hydrophobic fabric.

According to yet another preferred embodiment of the invention, the reactive system comprises a blended polyisocyanate, polyol, catalyst and stabilizer.

According to yet another preferred embodiment of the invention, the protective padding, substrate and outer cover are sandwiched together in overlying layers and joined together around their respective peripheral edges by sewing stitches to form a unitary structure.

According to one preferred embodiment of the invention, a batter's lower leg protector product includes a foot protector for being releasably attached to a lower, centrally-disposed area of the lower leg protector for providing protection to the top of the foot. The foot protector is initially enclosed in the container in substantially moisture-free conditions and sealed therein against entry of moisture until use. The foot protector is shaped to provide protection to the top of the foot. The foot protector comprises a substrate and a reactive system impregnated into or coated onto the substrate, the system remaining stable when maintained in substantially moisture-free conditions and hardening upon exposure to moisture to form a rigid, self supporting structure. A flexible protective pad is positioned on one side of the substrate to provide cushioning between the substrate and the batter when the foot protector is being worn. An outer cover covers the substrate on the side opposite the protective pad. The substrate, protective pad and outer cover are connected together into a unitary structure for being molded while flexible to the foot of the batter. A fastener is attached to a top side edge of the foot protector for cooperating with a complementary fastener attached to a lower portion of the lower leg protector to hold the foot protector in place on the top of the batter's foot while being worn.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
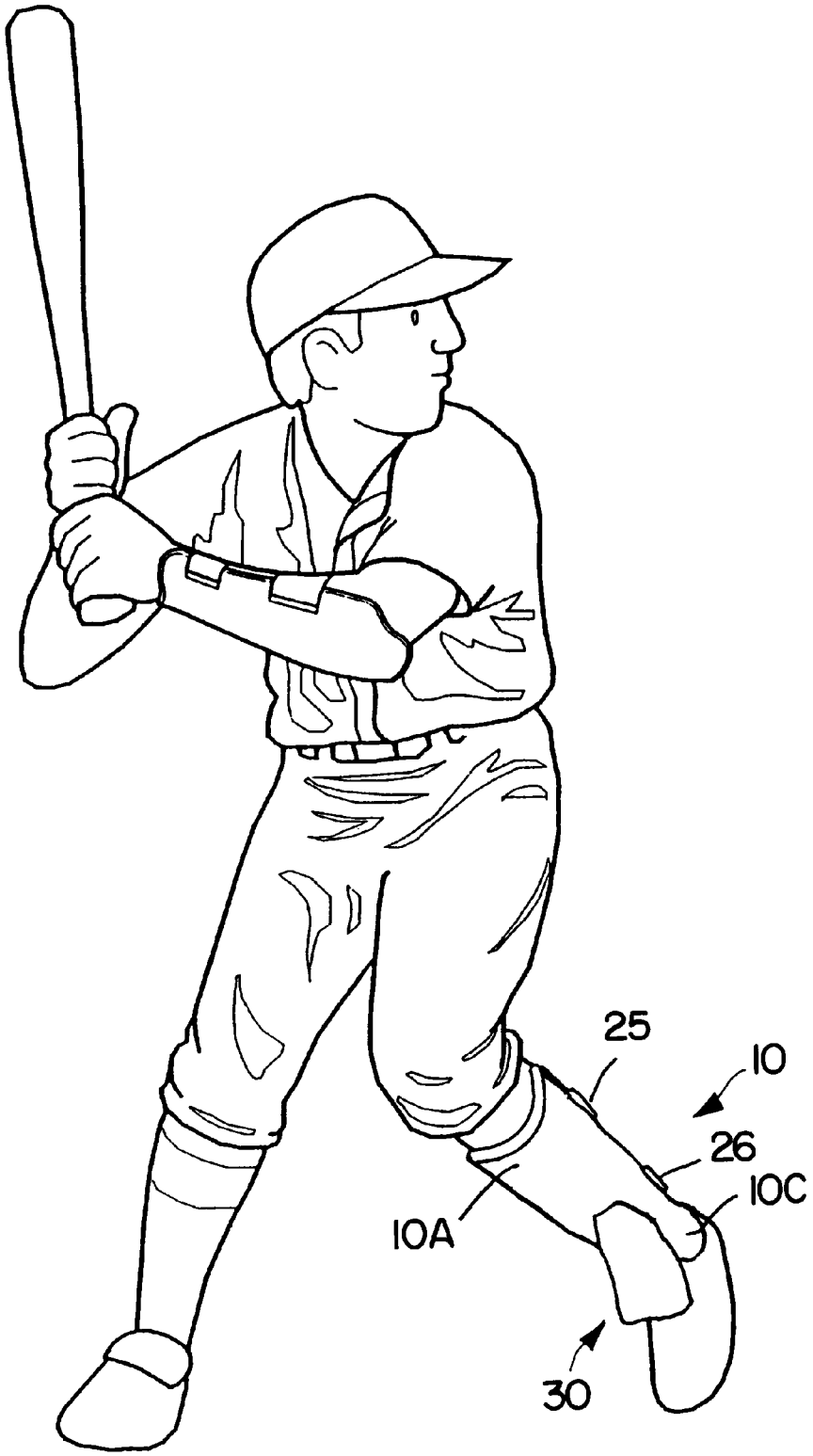
FIG. 1 illustrates a baseball or softball batter wearing a lower leg protector according to an embodiment of the present invention.
Figure 2:
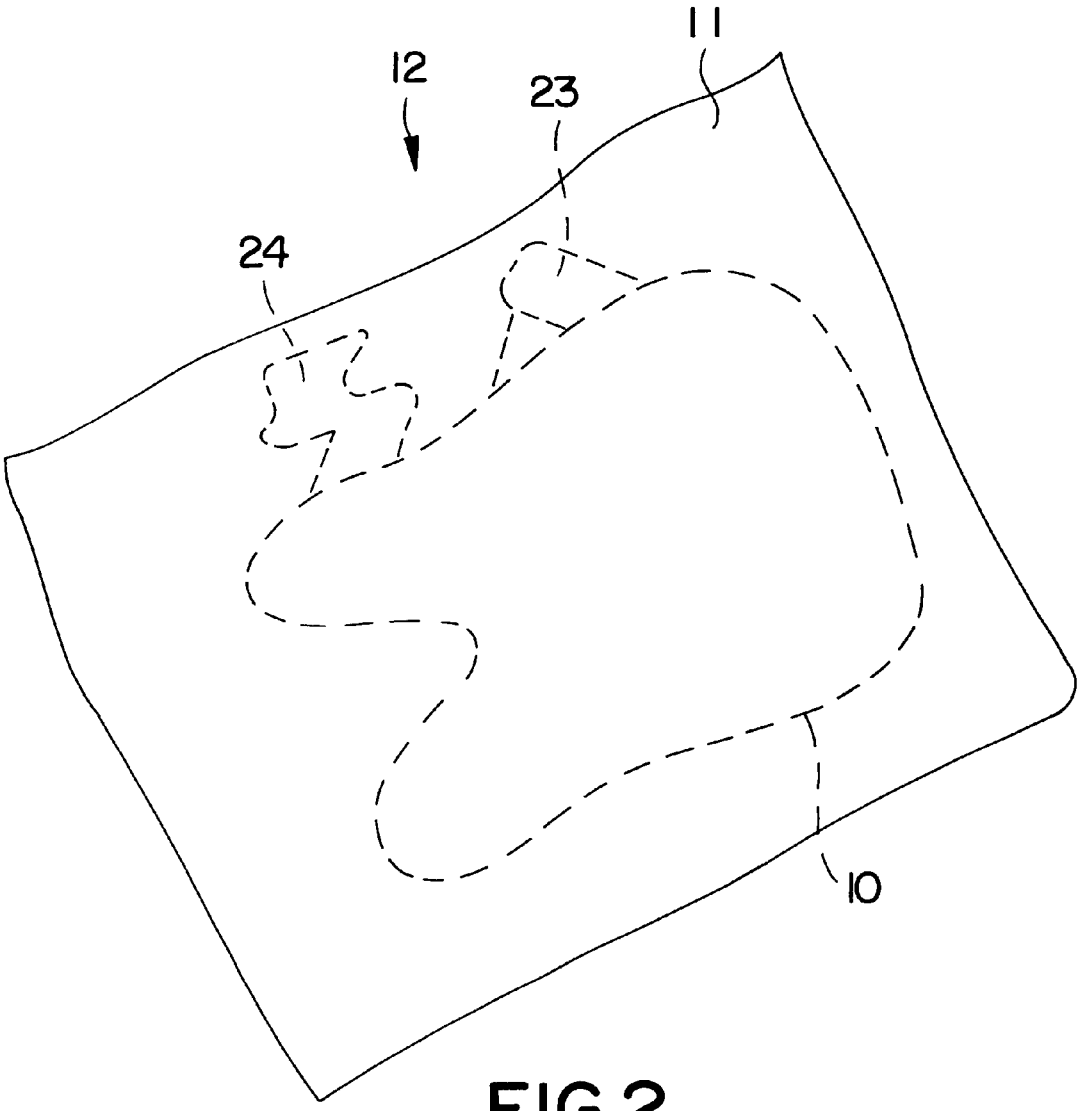
FIG. 2 is a perspective view of the protective container within which the lower leg protector is contained in moisture-free conditions until use.
Figure 3:
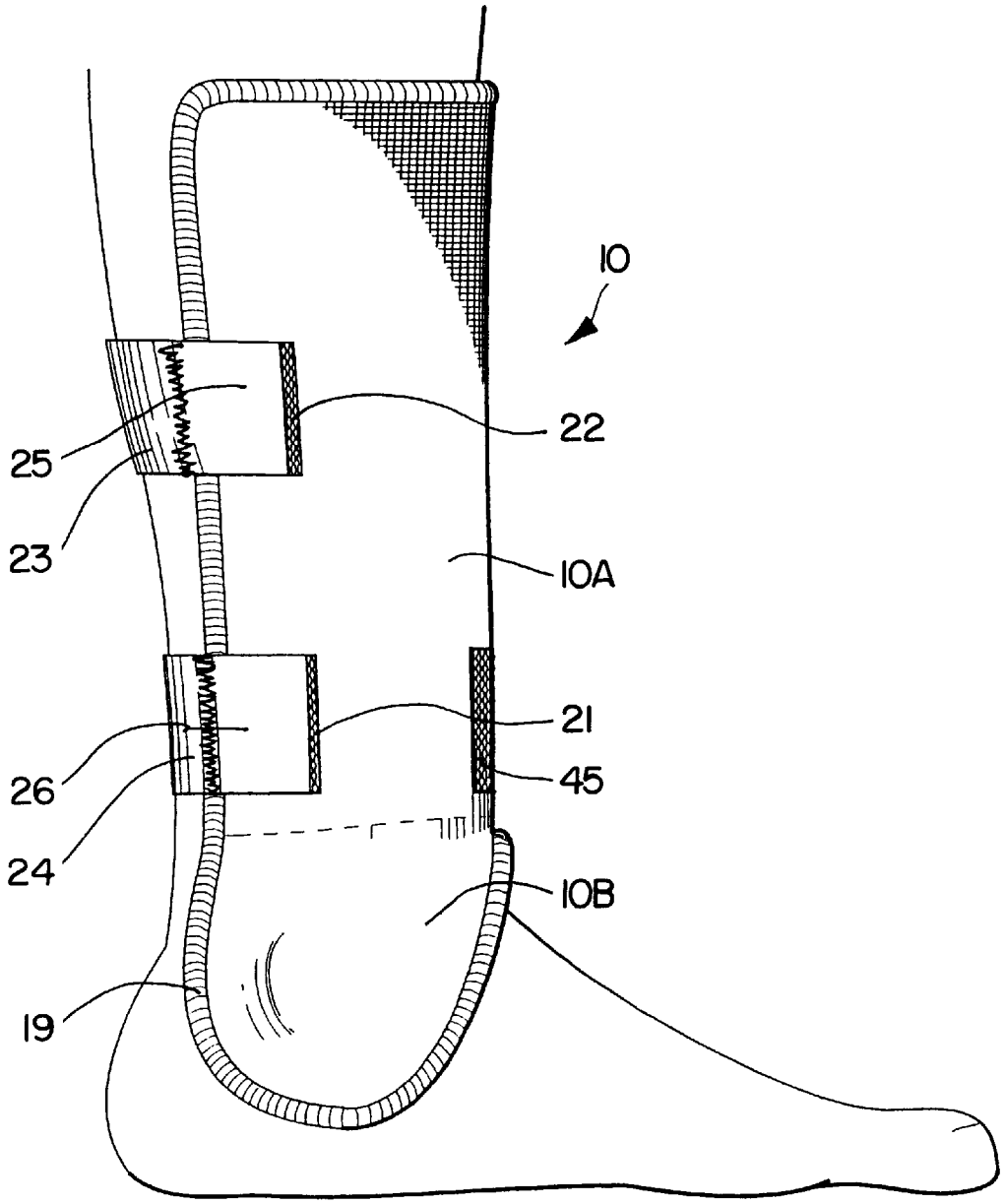
FIG. 3 is a side elevation of the lower leg protector in place on the lower leg of a batter.

Referring now specifically to the drawings, a lower leg protector product according to a preferred embodiment of the invention is illustrated broadly at reference numeral 12 in FIG. 2. A sealed, moisture-impervious foil and plastic laminated pouch or container 11 is fabricated of a aluminum foil laminate having an outer tear resistant layer, a central aluminum foil layer and an inner heat sealable plastic layer. Container 11 is opened with scissors or a knife, and a lower leg protector 10 according to an embodiment of the invention is removed. The lower leg protector 10 is shown in place on the lower leg of a batter in FIG. 1.

Referring now to FIGS. 3, 4, 5 and 6, the lower leg protector 10 is illustrated and shown in proper position on the leg of the batter.

The lower leg protector 10 includes a generally rectilinear portion 10A which is molded to and extends around the generally frustoconical structure of the lower leg and two opposed ankle-protecting flaps 10B, 10C. Ankle flaps 10B, 10C are formed of separate segments of the substrate material to permit hinged movement after molding, as described below. In play, the ankle flaps 10B, 10C reside on the outside of the shoe.

Figure 7:
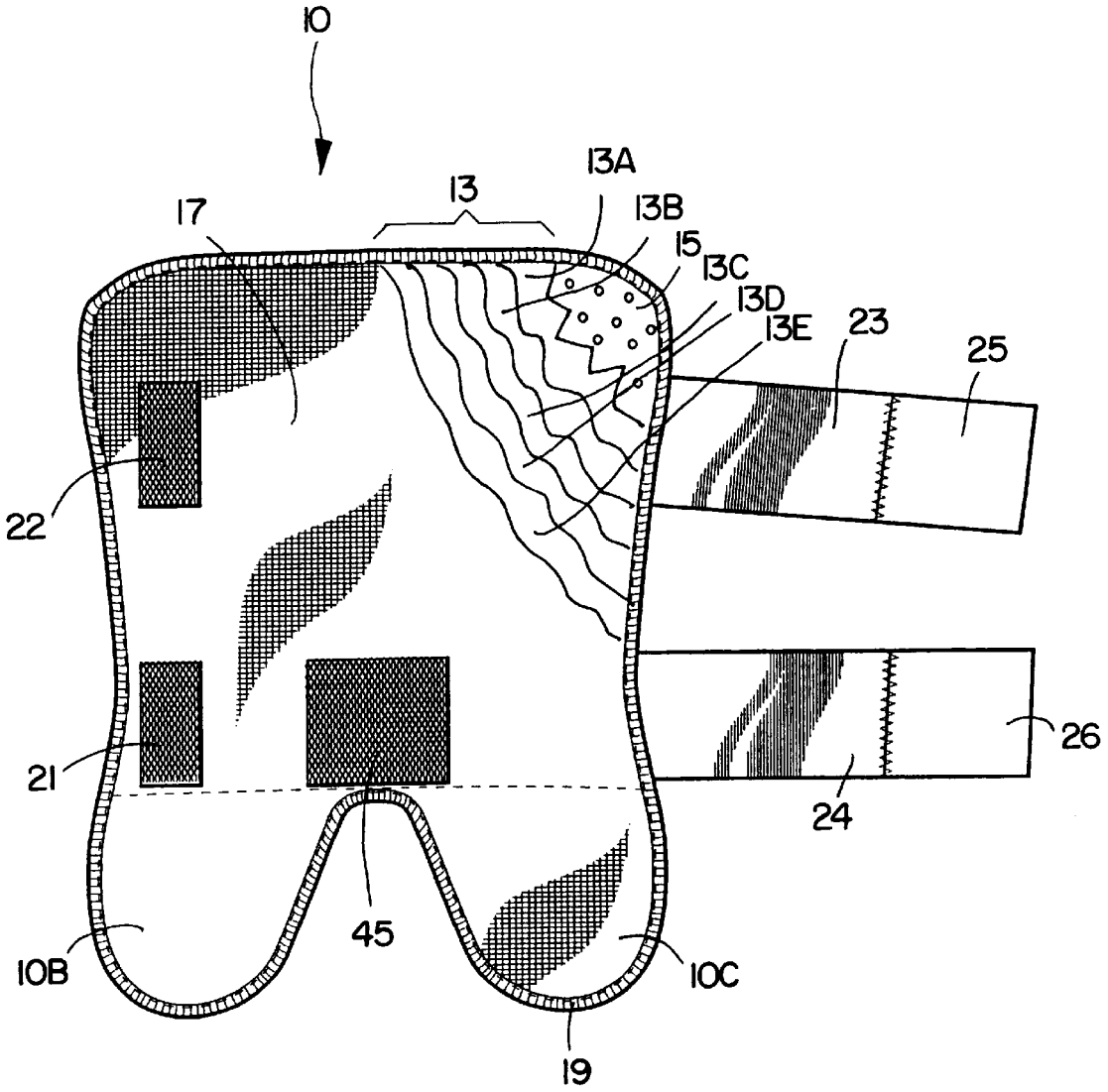
FIG. 7 is a plan view of the outer side of the lower leg protector with parts broken away to illustrate the construction of the leg protector.

Referring now to FIG. 7, the leg protector 10 includes a multilayer substrate 13 formed of, for example, five layers of woven fiberglass fabric 13A–E overlaid in registration with each other to form a laminated structure.

Other fabric material and constructions, such as knitted polypropylene, can also be used for the substrate fabric.

The fiberglass fabric layers 13A–E of the substrate 13 are impregnated or coated with a moisture-curable resin such as polyisocyanate as described in full in the U.S. Pat. No. 4,770,299. This reactive system remains stable when maintained in substantially moisture-free conditions, such as in the moisture-impervious pouch 11, but hardens upon exposure to sufficient moisture to form a rigid, self-supporting structure. A typical formulation of the reactive system is set forth in the following table:

| Typical Formulation: | | | |
|---|---|---|---|
| Isonate↓ 143L | or | | |
| Mondur↓ CD | or | polyisocyanate | 50.0% |
| Rubinate↓ X1168 | | | |
| Pluracol↓ P1010 | | polyol | 46.6% |
| DC-200 Silicone | | defoaming agent | 0.30% |
| Benzoyl Chloride | | stabilizer | 0.10% |
| Thancat↓ DM-70 | | catalyst | 3.0% |
| | | | 100% |

A complete discussion of the parameters of the reactive system, the manner of production and the variables which apply are found in U.S. Pat. No. 4,411,262.

The polyisocyanate resin remains in a viscous, liquid unhardened state so long as the resin is not exposed to moisture. This permits the fiberglass layers 13A–E to remain flexible and moldable so long as the resin is not exposed to moisture, and for a relatively short period of time after exposure to moisture. The curing time can be controlled to some extent by the quantity of water to which the resin is exposed. For example, exposure to water by dipping will result in quite rapid curing, while merely allowing the resin to be exposed to air will cause long curing times proportional to the amount of moisture in the air to which it is exposed.

Resin coated or impregnated fiberglass layers 13A–E are covered with a foam protective pad 15 which may be a single thickness or a laminated structure. One preferred embodiment is a 3/16 inch, six pound EVA (ethylene vinyl acetate) pad. Another embodiment may be a ⅜ inch laminated pad of a ⅛ inch outer EVA pad and a ¼ inch outer polyethylene/polyurethane, combination open and closed cell foam. Spaced-apart ventilation holes 15A permit rapid penetration of water to the substrate 13 during wetting and curing, and permit improved air flow and cooling while being worn by the player.

The pad 15 covers and provides cushioning between the skin and the rigid substrate 13. The pad 15 is flexible enough to bend easily with the other components of the lower leg protector 10 during fitting and curing. The pad 15 underlies the entire length and width of the lower leg protector 10. The pad 15 and the substrate 13 are approximately the same thickness—on the order of about 4–6 mm.

A fabric outer cover 17 such as a woven polyester fabric, covers the side of the substrate 13 opposite the side covered by the foam pad 15. The fabric outer cover 17 is sewn with, for example, an overedge or serging seam 19 directly to the edges of the foam pad 15 enclosing the substrate 13.

Patches 21, 22 of male or female hook-and-loop material are sewn or otherwise secured onto the leg protector 10 adjacent one side edge. Attachment straps 23, 24 having patches 25, 26 of male or female hook-and-loop material complementary to patches 21, 22 are sewn to the leg protector adjacent the opposing side edge and are extended around the calf of the lower leg and releaseably attached to the patches 21, 22, respectively to keep the lower leg protector 10 securely in position on the lower leg. The attachment straps 23, 24 may also be used when initially molding the lower leg protector to the leg, or the lower leg protector may be overwrapped with, for example, an elastic bandage until hardening is complete. The lower leg protector 10 will harden within a matter of minutes, and will permanently retain the conformation in which it was held during curing. The fit is so close and exact that the pad 15 can be very thin and still offer excellent protection to the batter. This is an important consideration since the lower leg protector 10 must not interfere with the batter's mobility while in the batter's box and during base running.

Figure 4:
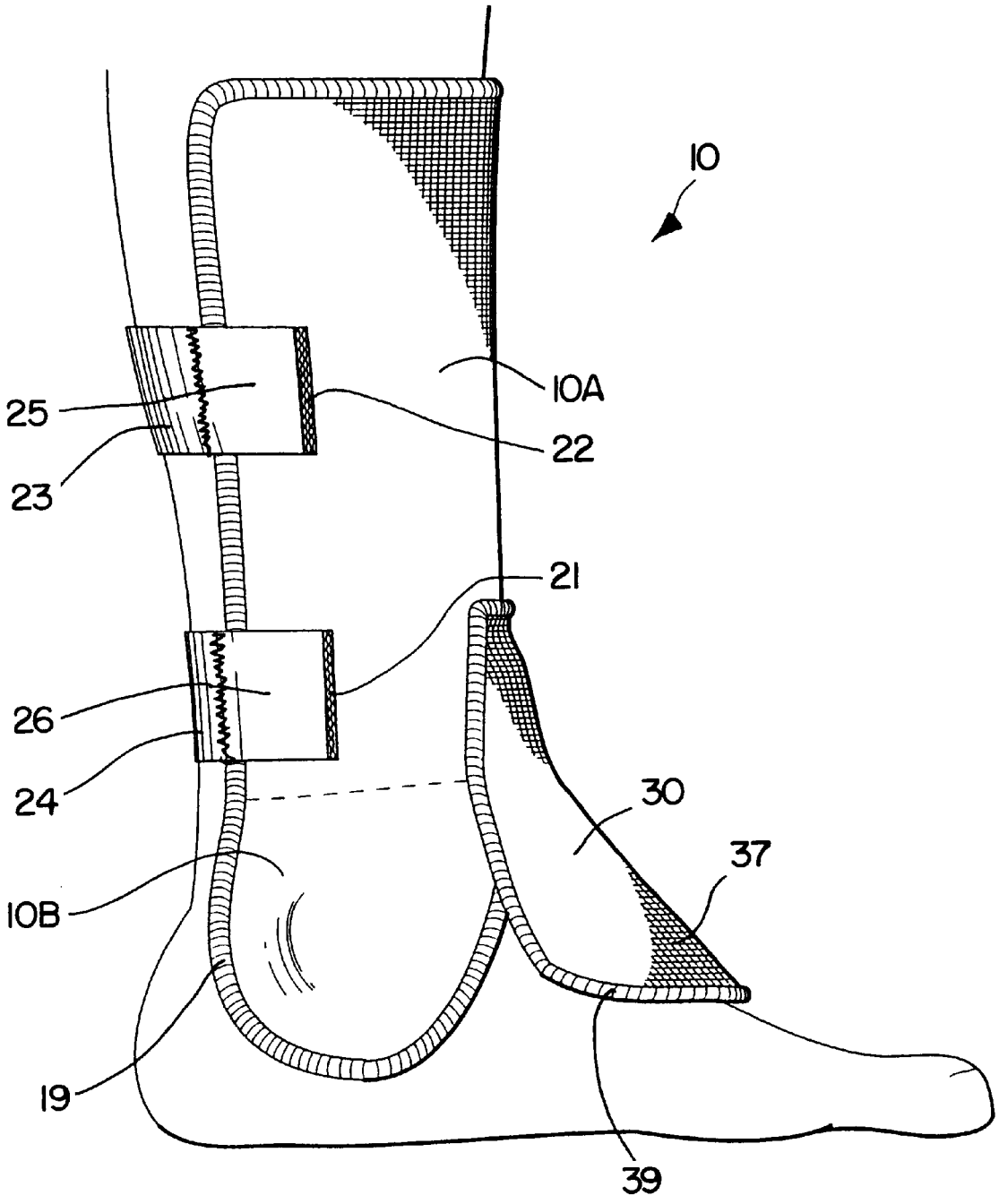
FIG. 4 is a side elevation of the lower leg protector and foot protector in place on the lower leg of a batter.
Figure 5:
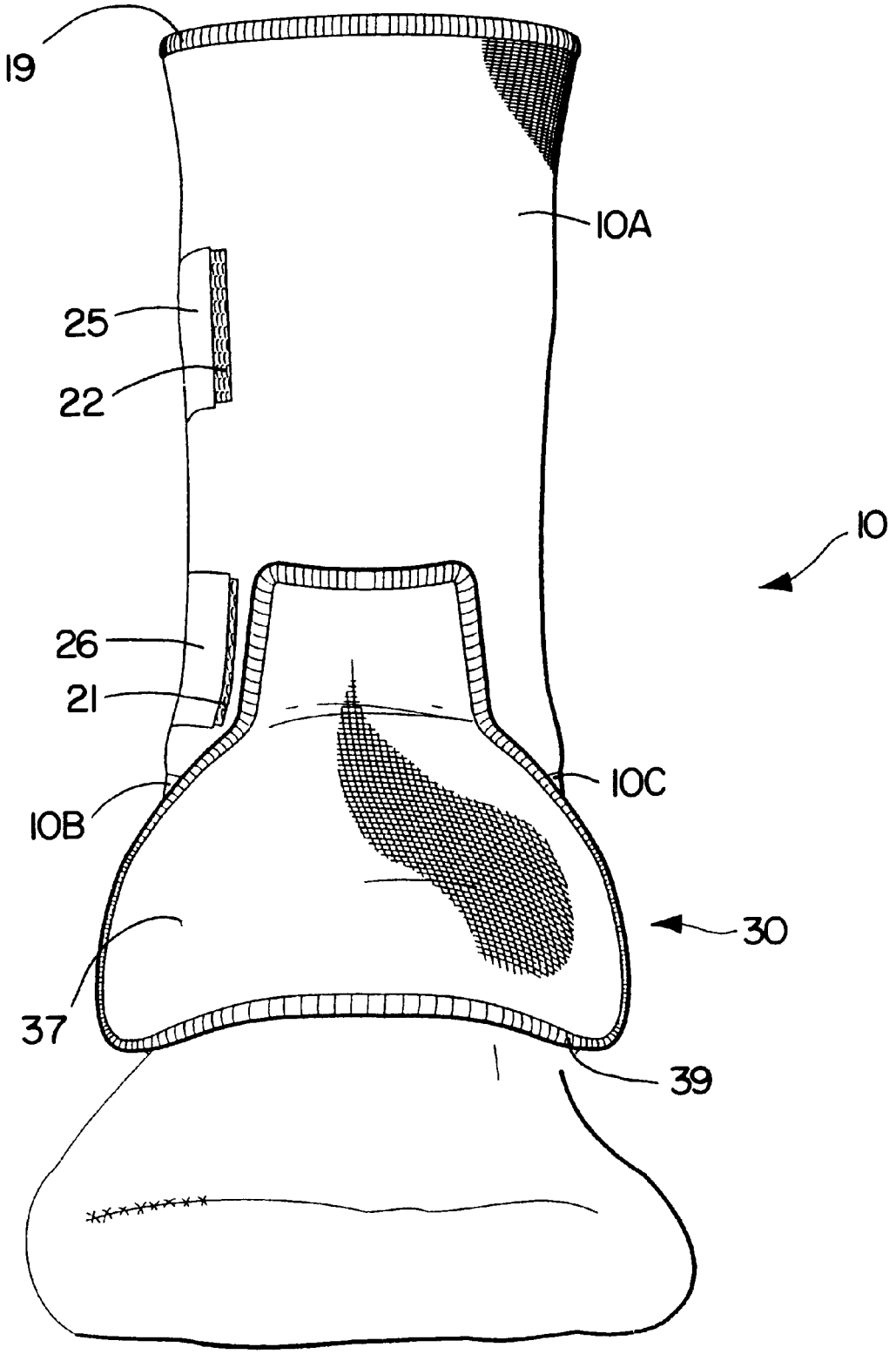
FIG. 5 is a front elevation of the lower leg protector and foot protector shown in FIG. 4.
Figure 6:
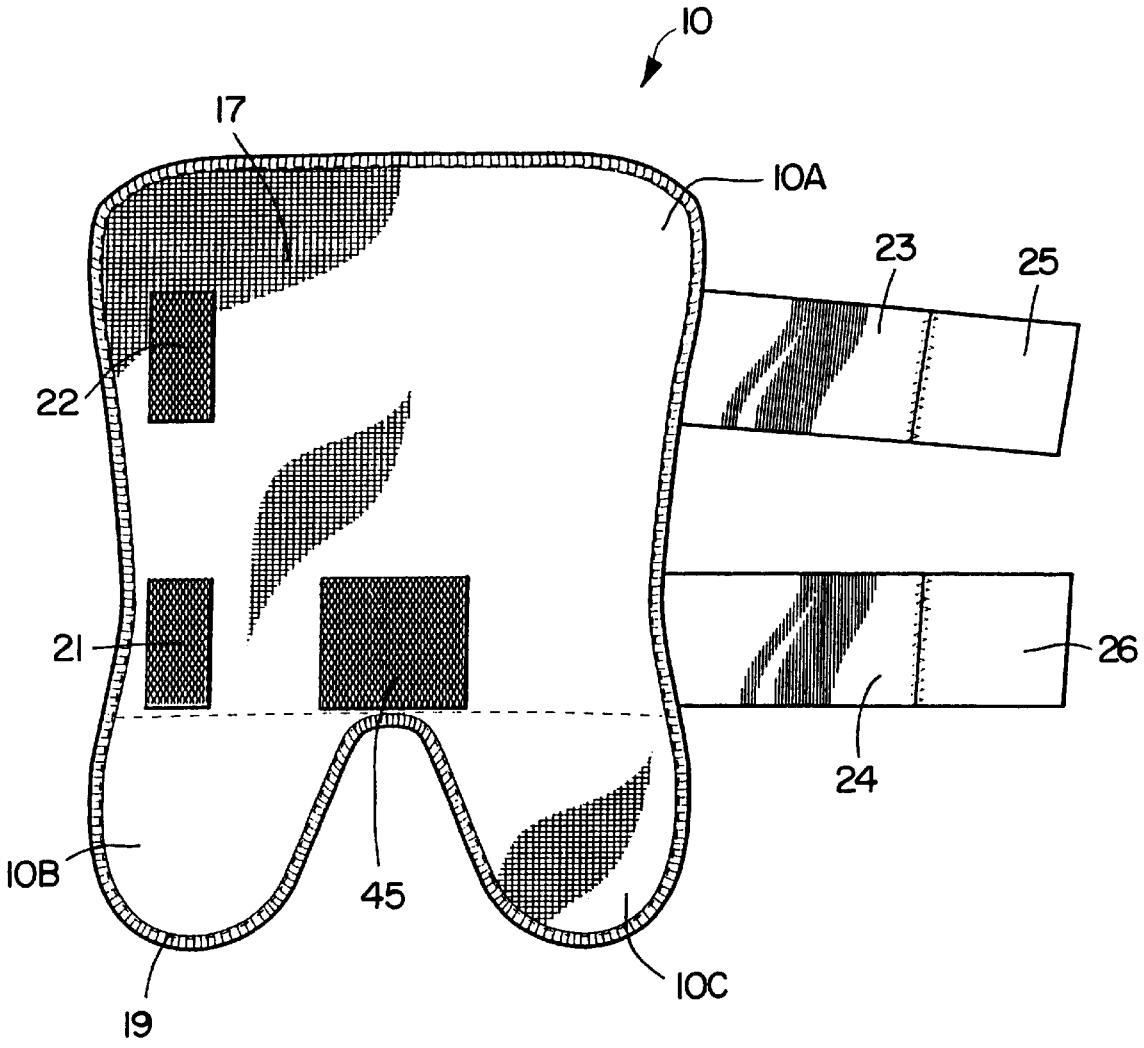
FIG. 6 is a plan view of the outer side of the lower leg protector.
Figure 8:
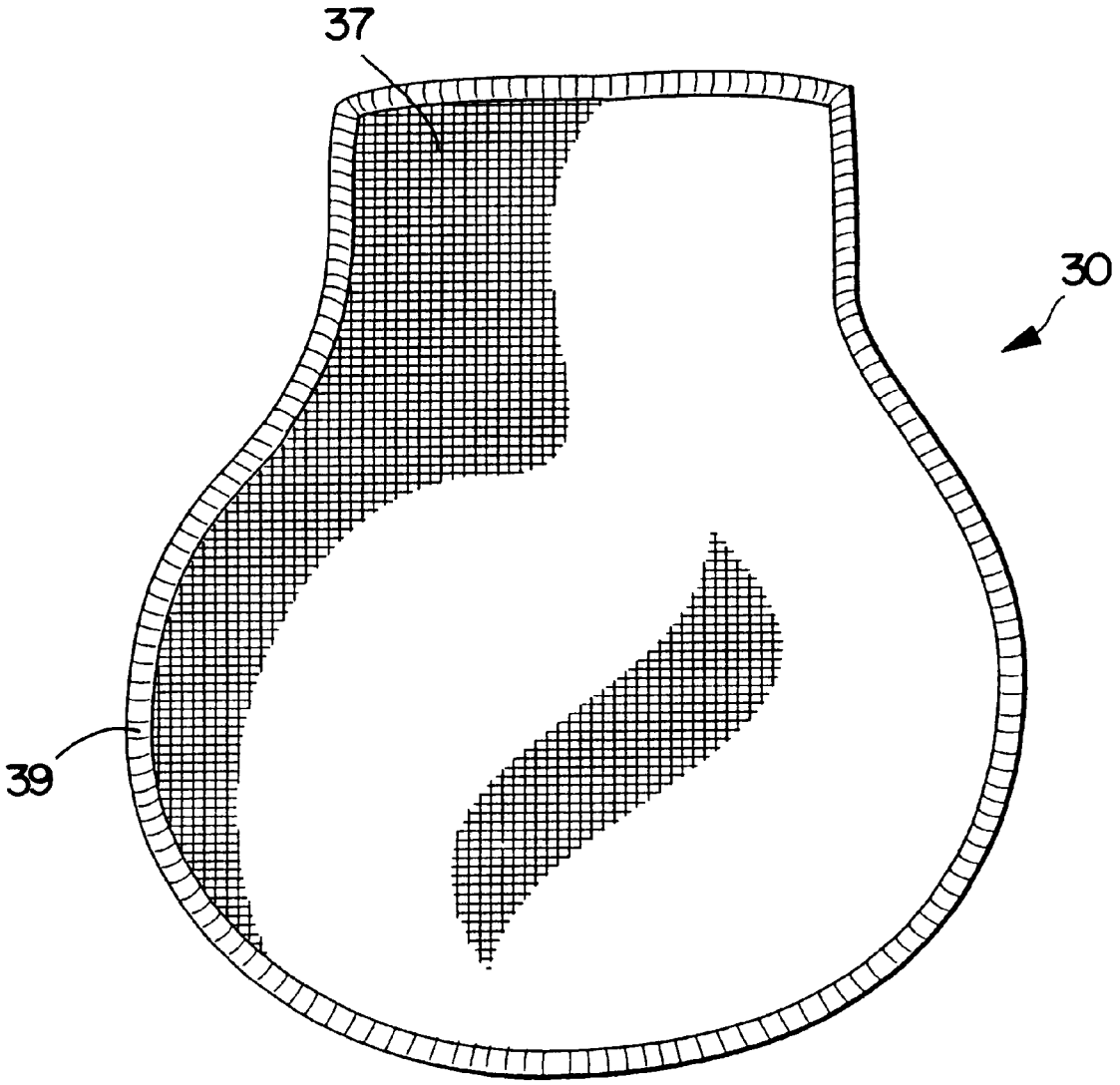
FIG. 8 is a plan view of the outer side of the foot protector.
Figure 9:
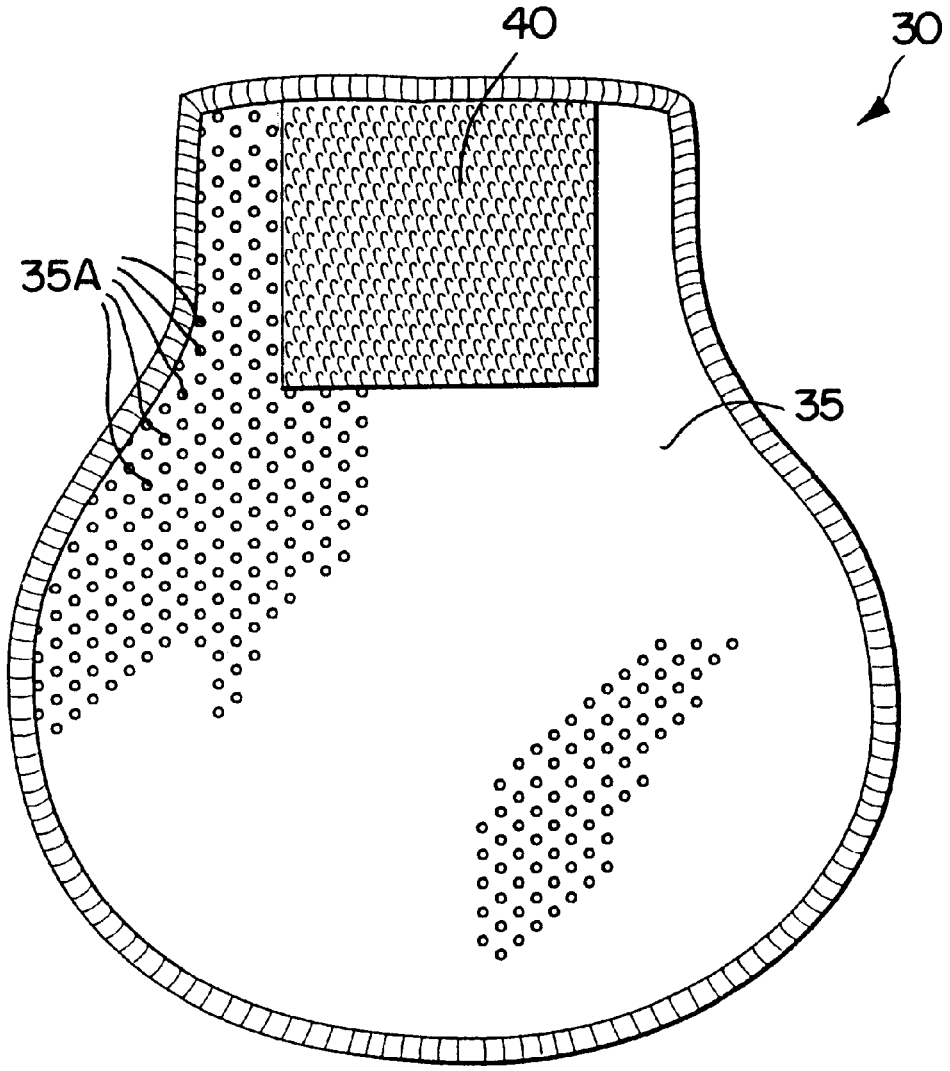
FIG. 9 is a plan view of the inner side of the foot protector.
Figure 10:
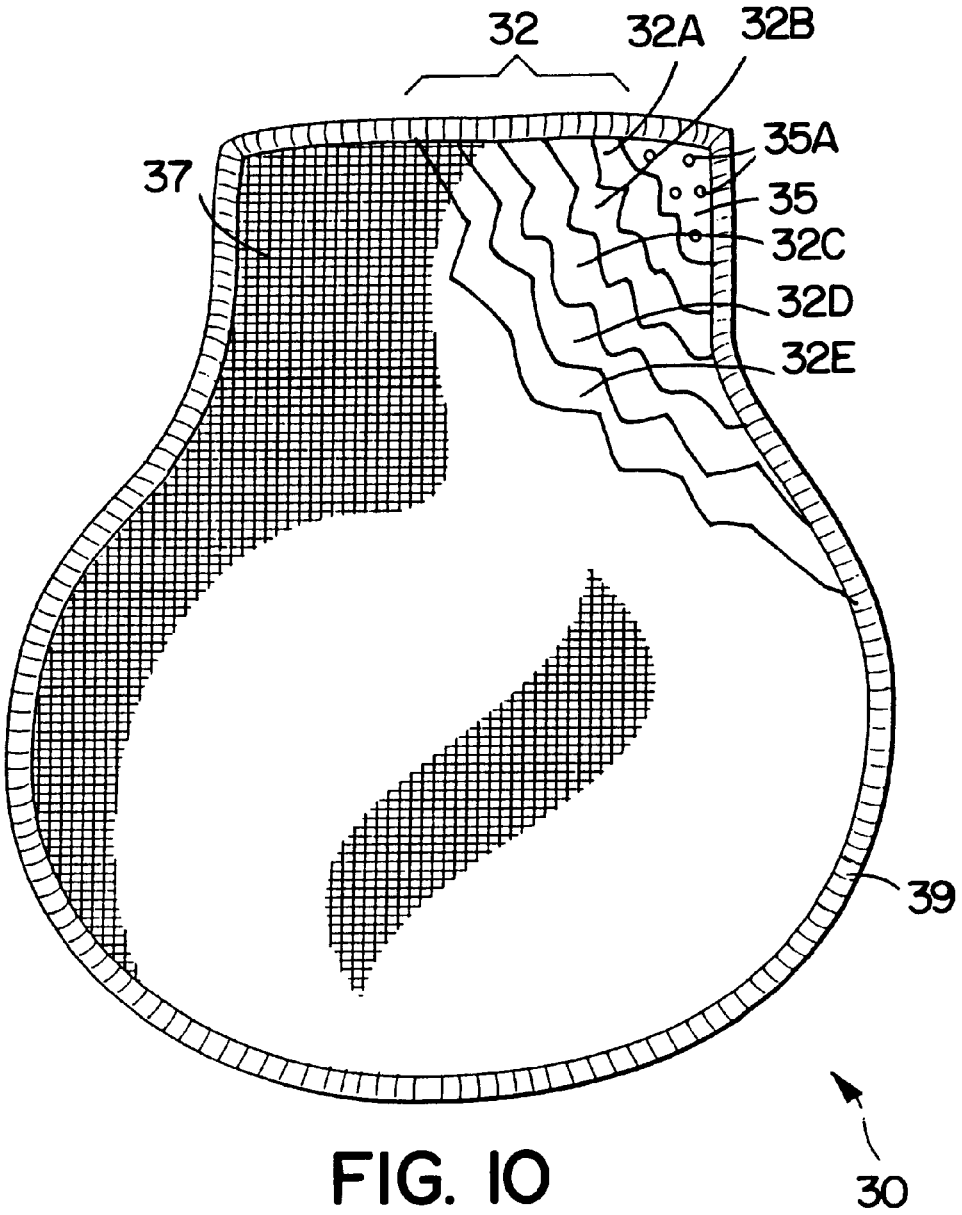
FIG. 10 is a plan view of the outer side of the foot protector with parts broken away to illustrate the construction of the foot protector.

As is shown in FIGS. 1, 4 and 5, a foot protector 30 can be combined with the lower leg protector 10 to provide protection to the top of the foot of the batter. As is shown in FIGS. 8, 9 and 10, the foot protector 30 has a construction identical to that of the lower leg protector 10. In play it resides outside the shoe. Specifically, the foot protector 30 includes a multilayer substrate 32 formed of, for example, five layers of woven fiberglass fabric 32A–E overlaid in registration with each other to form a laminated structure. Other fabric material and constructions, such as knitted polypropylene, can also be used for the substrate fabric.

The fiberglass fabric layers 32A–E of the substrate 32 are impregnated or coated with a moisture-curable resin such as polyisocyanate as described in full above.

The polyisocyanate resin remains in a viscous, liquid unhardened state so long as the resin is not exposed to moisture. This permits the fiberglass layers 32A–E to remain flexible and moldable so long as the resin is not exposed to moisture, and for a relatively short period of time after exposure to moisture.

Resin coated or impregnated fiberglass layers 32A–E are covered with a foam protective pad 35 which may be a single thickness or a laminated structure. One preferred embodiment is a 3⁄16 inch, six pound EVA (ethylene vinyl acetate) pad or a ⅜ inch laminated pad of a ⅛ inch outer EVA pad and a ¼ inch outer polyethylene/polyurethane, combination open and closed cell foam, as described above. Spaced-apart ventilation holes 35A permit rapid penetration of water to the substrate 32 during wetting and curing, and permit improved air flow and cooling while being worn by the player. See FIG. 9. The pad 15 underlies the entire length and width of the lower leg protector 10.

A fabric outer cover 37 such as a woven polyester fabric, covers the side of the substrate 32 opposite the side covered by the foam pad 35. The fabric outer cover 37 is sewn with, for example, an overedge or serging seam 39 directly to the edges of the foam pad 35 enclosing the substrate 32.

A patch 40 of male or female hook-and-loop material (male shown) is sewn or otherwise secured onto the inner side of the foot protector 30 adjacent the top side edge. The patch 40 releasably attaches to a complementary patch 45 of male or female hook-and-loop material (female shown) sewn or otherwise attached to the outer side of the lower leg protector adjacent the bottom side edge. See FIG. 7.

The attachment of the foot protector 30 to the lower leg protector is a hinged type of attachment which permits the foot protector 30 to move freely as needed to permit full range of movement by the batter. The foot protector 30 may be quickly removed if desired. The patches 40 and 45 are sufficiently large that the position of the foot protector 30 can be adjusted somewhat to the position of the lower leg protector 10 while maintaining a secure attachment.

A custom-formable batter's lower leg protector is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A batter's lower leg protector product including a lower leg protector for being custom-formed to the shape of a batter's lower leg while flexible and upon hardening providing a rigid, supporting custom fit, said lower leg protector product comprising:

(a) an outer container formed of moisture-impervious material;

(b) a flexible lower leg protector positioned in the container in substantially moisture-free conditions and sealed therein against entry of moisture until use, the lower leg protector shaped to provide, when in place on a batter's leg, protection to the front, lateral and medial aspect of the leg above the ankle and to the lateral and medial ankle bones, said lower leg protector comprising:

(i) a substrate;

(ii) a reactive system impregnated into or coated onto the substrate, the system remaining stable when maintained in substantially moisture-free conditions and hardening upon exposure to moisture to form a rigid, self supporting structure;

(iii) a flexible protective pad positioned on one side of the substrate to provide cushioning between the substrate and the batter's lower leg when the lower leg protector is being worn;

(iv) an outer cover covering the substrate on the side opposite the protective pad; and (v) said substrate, protective pad and outer cover connected together into a unitary structure for being molded while flexible to the lower leg and ankle of the batter;

(c) complementary fasteners attached to opposing side edges of tile lower leg protector for retaining the lower leg protector in place on the batter's leg while being worn;

(d) a foot protector for being releasably attached to a lower, centrally-disposed area of the lower leg protector for providing protection to the top of the foot, said foot protector being initially positioned in the container in substantially moisture-free conditions and scaled therein against entry of moisture until use and comprising:

(i) a substrate, (ii) a reactive system impregnated into or coated onto the substrate, the system remaining stable when maintained in substantially moisture-free conditions and hardening upon exposure to moisture to form a rigid, self supporting structure;

(iii) a flexible protective pad positioned on one side of the substrate to provide cushioning between the substrate and the batter's foot when the foot protector is being worn;

(iv) a outer cover covering the substrate on the side opposite the protective pad; and (v) said substrate, protective pad and outer-cover connected together into a unitary structure after being molded while flexible to the top of the foot of the batter; and (vi) complementary fasteners cooperating with the leg protector and the foot protector for attachment of the foot protector to the front of the leg protector when enhanced protection to the top of the foot is desired, and for detachment of the foot protector from the front of the leg protector when enhanced mobility of the wearer is desired while maintaining full protection to the leg.

2. A batter's lower leg protector product according to claim 1, wherein said complementary fasteners comprise patches of hook-and-loop material.

3. A batter's lower leg protector product according to claim 1, or 2, wherein the container is fabricated of an aluminum foil laminate having an outer tear resistant layer, a central aluminum foil layer and an inner heat sealable plastic layer.

4. A batter's lower leg protector product according to claim 1, wherein the substrate comprises a plurality of knitted or woven fabric layers.

5. A batter's lower leg protector product according to claim 1, wherein the protective pad comprises a foam material.

6. A batter's lower leg protector product according to claim 5, wherein the foam material is chosen from the group consisting of open or closed cell EVA or polyurethane.

7. A batter's lower leg protector product according to claim 1, wherein the outer cover is formed of a synthetic, hydrophobic fabric.

8. A batter's lower leg protector product according to claim 1, wherein the reactive system comprises a blended polyisocyanate, polyol, catalyst and stabilizer.

9. A batter's lower leg protector product according to claim 1, wherein said protective padding, substrate and outer cover are sandwiched together in overlying layers and joined together around their respective peripheral edges by sewing stitches to form a unitary structure.

10. A batter's lower leg protector product according to claim 1, wherein the fastener attached to the foot protector and its complementary fastener comprise patches of hook-and-loop material.

* * * * *

UNITED STATES PATENT AND TRADEMARK OFFICE

CERTIFICATE OF CORRECTION

PATENT NO : 6,131,195

DATED : October 17, 2000

INVENTOR(S) : Foreman, Louis J.

It is certified that error appears in the above-identified patent and that said Letters Patent are hereby corrected as shown below:

In Claim 1(b), line 6, delete "aspect" and insert "aspects".

In Claim 1(c), line 2, delete "tile".

In Claim 1(d), line 5, delete "scaled" and insert "sealed".

In Claim 1(d)(v), line 2, delete "after" and insert "for".

Signed and Sealed this

Twenty-second Day of May, 2001

*Attest:*

Nicholas P. Godici

NICHOLAS P. GODICI

*Attesting Officer*

*Acting Director of the United States Patent and Trademark Office*